US007493057B2

(12) United States Patent
Facci et al.

(10) Patent No.: US 7,493,057 B2
(45) Date of Patent: Feb. 17, 2009

(54) INLINE PURGE CAPABILITY (PURGE WHILE RUN) TO IMPROVE SYSTEM PRODUCTIVITY DURING LOW AREA COVERAGE RUNS

(75) Inventors: John S. Facci, Webster, NY (US); John G. Elliot, Penfield, NY (US); Robert M. Mara, Fairport, NY (US); Richard L. Forbes, II, Pittsford, NY (US); James P. Kitchen, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 251 days.

(21) Appl. No.: 11/540,798

(22) Filed: Sep. 29, 2006

(65) Prior Publication Data

US 2008/0080876 A1 Apr. 3, 2008

(51) Int. Cl.
*G03G 15/08* (2006.01)

(52) U.S. Cl. ..... 399/27; 399/49

(58) Field of Classification Search ..... 399/9, 399/24, 27, 29, 38, 49, 72
See application file for complete search history.

(56) References Cited

U.S. PATENT DOCUMENTS 6,047,142 A 4/2000 Donaldson
6,167,213 A 12/2000 Buranicz et al.
6,167,214 A 12/2000 Scheuer et al.
6,169,861 B1 1/2001 Hamby et al.
6,175,698 B1 1/2001 Scheuer et al.
6,404,997 B1 6/2002 Grace
6,505,832 B2 1/2003 Moore et al.
6,790,573 B2 9/2004 Drappel et al.
6,871,029 B2 * 3/2005 Brewington et al. ..... 399/27
7,177,557 B2 * 2/2007 Kreckel ..... 399/27
7,263,301 B2 * 8/2007 Martin et al. ..... 399/27
2005/0286917 A1 12/2005 Martin et al.

* cited by examiner

*Primary Examiner*—Hoan H Tran
(74) *Attorney, Agent, or Firm*—Lloyd F. Bean, II

(57) ABSTRACT

An electrostatic printing machine having a plurality of color stations having a system for maintaining a preset toner age in each of the plurality of color stations, including: determining a toner age for each of the plurality of color stations; determining if purge while run is required based on the toner age for each of the plurality of color stations; defining an area on a unused portion of an imaging frame for a purge patch, the defining includes sizing a plurality of purge patch regions wherein each of the purge patch regions may have a different size; allocating each of the plurality of purge patch regions to at least one color plane from a group of color separations.

16 Claims, 9 Drawing Sheets

| PAPER WIDTH | PWR DUTY CYCLE | | ATP ELIMINATED? |
|---|---|---|---|
| | PWR REVS ON | PWR REVS OFF | |
| 11" | 5 | 2 | YES |
| 11" | 5 | 0 | YES |
| 11"-12" | 5 | 2 | ALMOST |
| 11"-12" | 5 | 1 | YES |
| 11"-12" | 5 | 0 | YES |

FIG. 7

INLINE PURGE CAPABILITY (PURGE WHILE RUN) TO IMPROVE SYSTEM PRODUCTIVITY DURING LOW AREA COVERAGE RUNS

CROSS REFERENCE TO RELATED APPLICATIONS

This application claims the benefit of U.S. Publication Ser. No. 11/120,342, filed on May 3, 2005.

BACKGROUND

The present invention generally relates to a digital imaging system. More specifically, the present invention provides an improved method and apparatus for maintaining toner age to ensure image quality by anticipating or diagnosing problems in image quality, which may be caused by toner age.

INCORPORATED BY REFERENCE

The following is specifically incorporated by reference: U.S. Pat. Nos. 6,404,997; 6,175,698; 6,169,861; 6,167,214; 6,167,213 and 6,790,573.

Modern electronic copiers, printers, facsimile machines, etc. are capable of producing complex and interesting page images. The pages may include text, graphics, and scanned or computer-generated images. The image of a page may be described as a collection of simple image components or primitives (characters, lines, bitmaps, colors, etc.). Complex pages can then be built by specifying a large number of the basic image primitives. This is done in software using a page description language such as POSTSCRIPT™. The job of the electronic printer's software is to receive and interpret each of the imaging primitives for the page. The drawing, or rasterization must be done on an internal, electronic model of the page. All image components must be collected and the final page image must be assembled before marking can begin. The electronic model of the page is often constructed in a data structure called an image buffer. The data contained is in the form of an array of color values called pixels. Each actual page and the pixel's value provide the color which should be used when marking. The pixels are organized to reflect the geometric relation of their corresponding spots. They are usually ordered to provide easy access in the raster pattern required for marking.

In the prior art, a copier, printer or other document-generating device typically employs an initial step of charging a photoconductive member to substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member, which is subsequently transferred to a copy sheet. The copy sheet having the toner image thereon is then advanced to a fusing station for permanently affixing the toner image to the copy sheet.

The approach utilized for multicolor electrophotographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color corresponding thereto and the process is repeated for differently colored images with the respective toner of corresponding color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are half-tone images. Therefore, many methods have been developed to monitor the toner development process to detect present or prevent future image quality problems.

For example, it is known to monitor the developed mass per unit area (DMA) for a toner development process by using densitometers such as infrared densitometers (IRDs) to measure the mass of a toner process control patch formed on an imaging member. IRDs measure total developed mass (i.e., on the imaging member), which is a function of developability and electrostatics. Electrostatic voltages are measured using a sensor such as an ElectroStatic Voltmeter (ESV). Developability is the rate at which development (toner mass/area) takes place. The rate is usually a function of the toner concentration in the developer housing. Toner concentration (TC) is measured by directly measuring the percentage of toner in the developer housing (which, as is well known, contains toner and carrier particles).

As indicated above, the development process is typically monitored (and thereby controlled) by measuring the mass of a toner process control patch and by measuring toner concentration (TC) in the developer housing. However, the relationship between TC and developability is affected by other variables such as ambient temperature, humidity and the age of the toner. For example, a three-percent TC results in different developabilities depending on the variables listed above. Therefore, in order to ensure good developability, which is necessary to provide high quality images, toner age must be considered.

Consequently, there is a need to provide a method and apparatus for calculating or determining toner age to ensure image quality by anticipating or diagnosing problems in image quality, which may be caused by toner age. These problems include low developability, high background, and halo defects appearing on sheets of support material. One method of managing the residence time of toner in the developer housing is to use a minimum area coverage (MAC) patch in the inter-page zone to cause a minimum amount of toner throughput which is disclosed in U.S. Pat. No. 6,047,142 which is hereby incorporated by reference.

As taught in that patent, during low area coverage runs, the development and transfer systems are stressed beyond their operating limits resulting in color drift, streaks, and development loss. The initial xerographic control implementation included a Minimum Area Coverage (MAC) patch algorithm. The minimum throughput is determined by calculating the average residence time of the toner in the development housing and is referred to as the toner age. The MAC patch algorithm starts printing patches in the inter document zone (IDZ) whenever the toner age reaches an upper limit and then stops printing when the toner age reached a lower limit. It has been found that there are instances when the MAC patch algorithm's capability is insufficient to maintain material health during extended low area coverage runs, requiring additional material management control schemes to maintain adequate development and transfer performance. Consequently the auto toner purge algorithm (ATP) is implemented to better manage the material state during low area coverage. With auto toner purge enabled, the system will enter a dead cycle whenever the toner age exceeds an upper limit. The ATP routine will develop a predetermined number of high area coverage patches to cause the developer sump to be refreshed with new toner. The routine takes between 3 and 4 minutes to complete. This routine has been shown to be very effective at maintaining development and transfer performance during long runs of low area coverage. However, in order to maintain the system performance during low area coverage runs, the system requires frequent ATPs. A major drawback to auto toner purge mode is that the print productivity of the printing machine is substantially reduced as a result of image frames being lost in the deadcycle, for example, it has been found that an ATP deadcycle may occur as frequently as every 2500 images. The productivity impact of the ATP deadcycle can be as great as 15%, thereby reducing the 100 ppm print engine to approximately 85 ppm.

SUMMARY

Briefly, in the present invention, the impact of the above problems is significantly reduced and the overall machine productivity is increased by providing an electrostatic printing machine having a plurality of color stations having a system for maintaining a preset toner age in each of said plurality of color stations, said system including: determining a toner age for each of said plurality of color stations; determining if purge while run is required based on said toner age for each of said plurality of color stations; defining an area on a unused portion of an imaging frame for a purge patch, said defining includes sizing a plurality of purge patch regions wherein each of said purge patch regions may have a different size or area; allocating each of said plurality of purge patch regions to at least one color plane from a group of color separations.

BRIEF DESCRIPTION OF THE DRAWINGS

FIGS. 5-9 are experimental modeling data of printing machine of the type of shown in FIG. 1 employing principles of the present disclosure.

DETAILED DESCRIPTION

Figure 1:
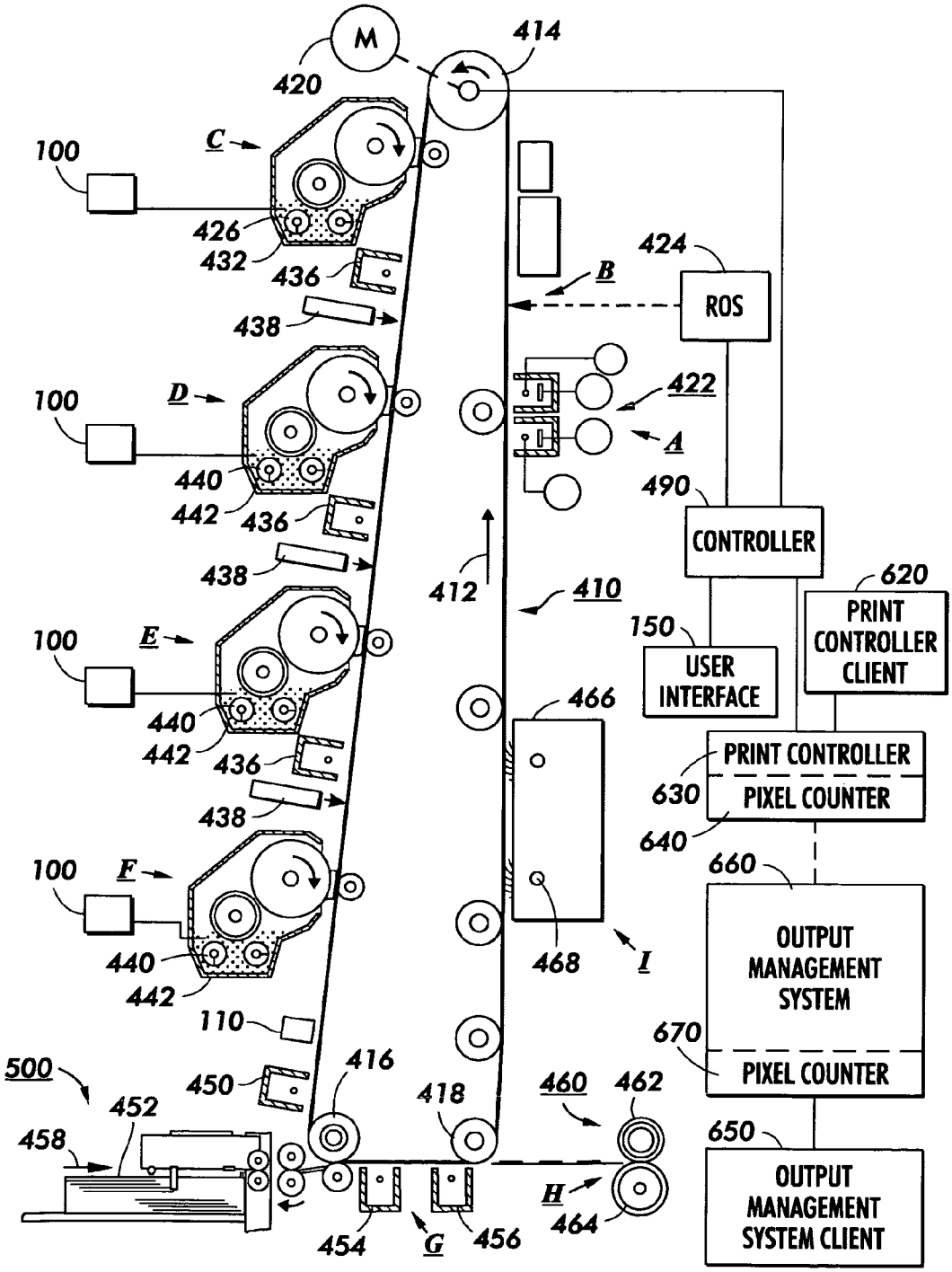
FIG. 1 is a partial schematic of an example of a print engine for a digital imaging system, which can employ the purge while run process of the present disclosure.

FIG. 1 is a partial schematic view of a digital imaging system, such as the digital imaging system of U.S. Pat. No. 6,505,832 which is hereby incorporated by reference. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

In this embodiment, printing jobs are submitted from the Print Controller Client 620 to the Print Controller 630. A pixel counter 640 is incorporated into the Print Controller to count the number of pixels to be imaged with toner on each sheet or page of the job, for each color. The pixel count information is stored in the Print Controller memory. Job control information, including the pixel count data, and digital image data are communicated from the Print Controller 630 to the Controller 490. The digital image data represent the desired output image to be imparted on at least one sheet.

FIG. 1 additionally shows an alternative embodiment in which an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490. In this alternative embodiment, pixel counting in the Print Controller 630 is not necessary since the data has been provided with the job control information from the Output Management System 660.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage $V_0$, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or background areas.

At a first development station C, developer structure, indicated generally by the reference numeral 432 utilizing a hybrid development system, the developer roller, better known as the donor roller, is powered by two developer fields (potentials across an air gap). The first field is the ac field which is used for toner cloud generation. The second field is the dc developer field which is used to control the amount of developed toner mass on the photoreceptor belt 410. The toner cloud causes charged toner particles 426 to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure that is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles 440. Further, a toner concentration sensor 100 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the image and non-image areas on the photoconductive surface are removed therefrom. These particles are removed at cleaning station I using a cleaning brush or plural brush structure contained in a housing 466.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets. The steps in the flow chart in FIG. 3 are repeated for each developer in FIG. 1 to measure the toner age.

Figure 3:
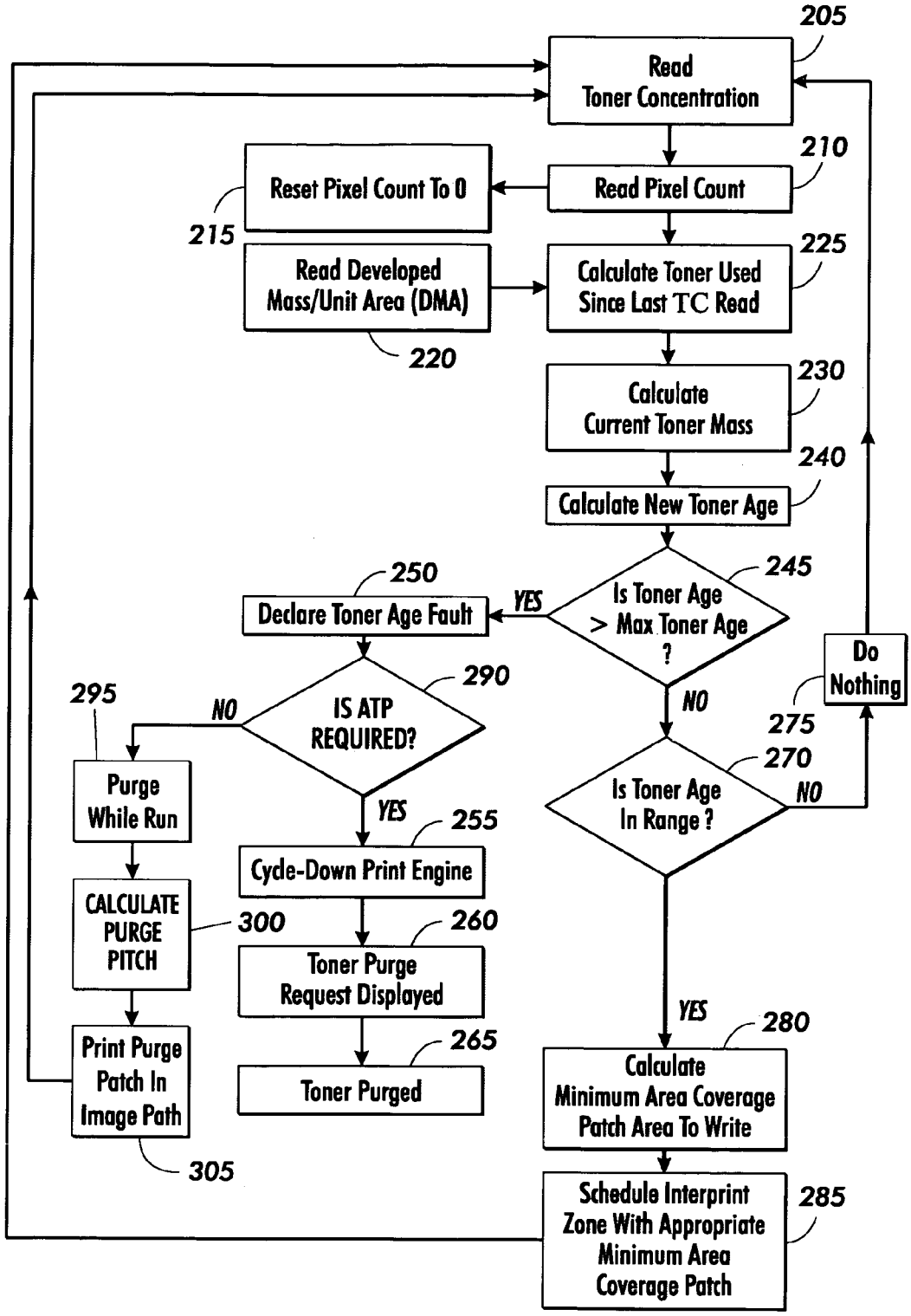
FIGS. 3 and 4 are flow charts showing the toner age calculation and the utilization of purge while run process of the present disclosure.

Now referring to FIG. 3 which is a flow chart showing the process that calculates toner age and takes appropriate action based upon the results of the toner age calculation. Preferably, the control unit reads the toner concentration (TC) every n seconds, wherein n is a positive number, and this number is stored in memory (step 205). The control unit reads the pixel count (step 210), and the pixel counter is reset to zero (step 215). The control unit 30 reads the developed mass per unit area (DMA), sensed by mass sensor 110, and stores the DMA in memory (step 220). The control unit 30 calculates the toner amount used since the last toner concentration was read (step 225) by using the DMA stored in memory.

Subsequently, the current toner mass in developer unit is calculated by control unit 30 (step 230) by using the following formula:

$$\text{Current Toner Mass}=(\text{toner concentration}/100)*\text{carrier mass} \quad \text{(Equation 2)}$$

The carrier mass varies depending upon the print engine, and is generally determined by the manufacturer based on a number of factors including size of print engine, toner stability, speed of print engine, etc.

Then, the new toner age is calculated by the control unit 30 (step 240) using the following formula:

$$\text{New Toner Age}=[(\text{Current Toner Mass}-\text{Toner Used})*(\text{Previous Toner Age}+n\text{ seconds}/60)]/\text{Current Toner Mass} \quad \text{(Equation 3)}$$

After the new toner age is calculated, the new toner age is compared to a predetermined maximum toner age, which is based on the appearance of image defects (step 245). An image is considered defective when the quality of the image does not meet predetermined customer, user or manufacturer print quality standards. If the current toner age is greater than the maximum toner age, then the control unit 30 recognizes a toner age fault (step 250) and determines if an automatic toner purge (ATP) is required (step 290).

In step 290, Print controller determines if a sufficient sized purge patch can be generated in an unused image area of an image frame (step 290). If not then the controller interrupts the current job (step 255) and an ATP routine is initiated. If a purge patch can be generated in an unused image area of an image frame then the size of the control patch is determined (step 300) and the purge patch is printed along with the current job (step 305). The inline purge routine (also known as purge while run (PWR)) creates patches in the unused area of the customer image panel increasing the material throughput in the system. Details of the PWR will be discussed in reference to FIG. 4. The increase in material throughput is sufficient such that most of the problems associated with extended runs of low area coverage are mitigated without the need to call the auto toner purge routine, thereby significantly improving system productivity. The ability to selectively place patches in the customer image area increases the amount of space available for control patches and enables a significant improvement in productivity. Preferably, the system uses the MAC patch and the purge while run capability for all situations under which the customer's job and image content enables the purge while run capability to execute. Under the circumstances in which the customer's job and image content do not allow for purge while run to execute, then the system will need to call upon the auto toner purge capability via a system deadcycle. When the toner age decreases below a pre-determined limit the system moves back to step 205.

During the course of a print job, a toned purge patch is printed in the area on the image panel that is not used by the customer image. At least two possibilities exist: when a customer is running images that are less than the maximum process width. There is area on the inboard side of the photoreceptor belt that is available for writing a toned image to maintain toner throughput. There is also considerable space on the trailing edge of the document for writing a toned image to maintain toner throughput. In the latter case the patch size can be independent of customer image width. This is a desirable capability, one that allows the customer to run on large paper for multiple-ups without having to rely on auto toner purge.

Returning back to FIG. 3, if there is no space for a purge while run patch then the system will raise a machine condition (fault) and enter an auto toner purge routine when the toner age exceeds the toner purge routine threshold. The toner age continues to be recalculated during the toner purge routine, as in run-time, except that during the purge routine an out-of-range toner age does not trigger a fault. The toner purge routine decreases the toner age, for example, by running a high area coverage image. At the end of the toner purge routine the interrupted job is reinitiated automatically.

If the new toner age is less than the predetermined maximum toner age, then the new toner age is compared to a predetermined toner age range (step 270). If the new toner age is less than a predetermined maximum? toner age in the toner age range, the quality of the images is not affected by toner age (step 275). The toner age calculation process is repeated at the next scheduled toner concentration read by returning to step 205. The predetermined maximum toner age is based on a variety of factors including cost to customer, productivity and image quality.

If the new toner age falls within the toner age range, then a minimum area coverage (MAC) patch area is calculated based on the current toner age (step 280). The preferred MAC patch calculation minimizes toner usage and maximizes print engine productivity, while ensuring that toner age is maintained within the safe range, avoiding the necessity for toner purging and job interruption. The MAC patch area may be calculated automatically based on toner age in a number of different ways such as utilizing a look-up table. An interprint zone with appropriate MAC patch(es) is scheduled (step 285).

Figure 2:
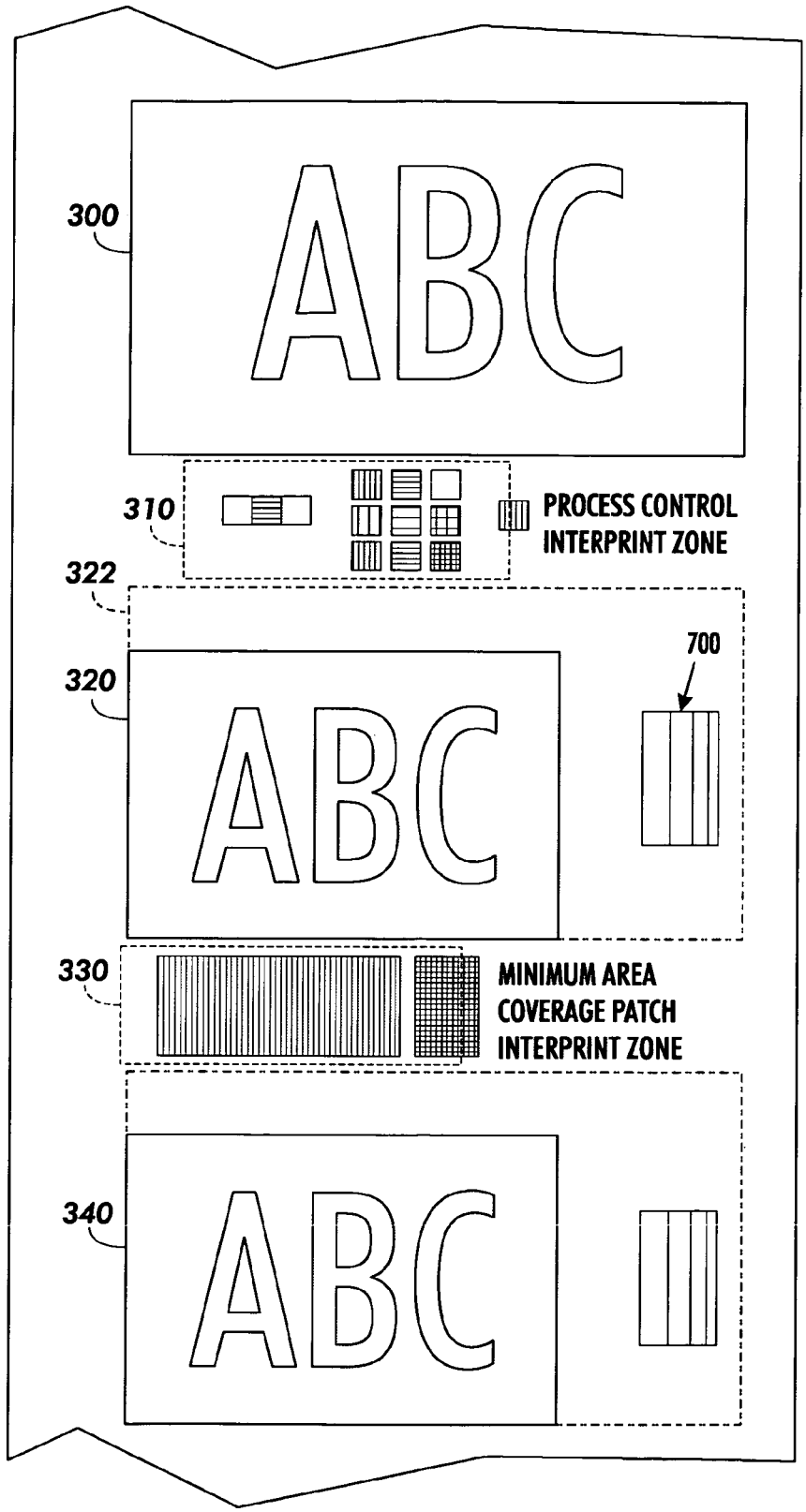
FIG. 2 is a layout showing one implementation of customer images, process control patches, MAC patches and purge patches on a photoreceptor.

FIG. 2 shows examples of a layout of customer images, process control patches, MAC patches and purge patches on a photoconductive surface (e.g. surface of photoreceptive belt 50) over time. A print zone on the surface dedicated to the customer image 300 is followed by an interprint zone 310 in which control patches are laid out to be read by electrostatic or development sensors. Another customer image within image frame 320 is laid out, followed by an interprint zone 330 in which one or more MAC patches are laid out, for the purpose of maintaining toner age. Purge patches are laid out in unused portion of the customer image frame 320. In FIG. 2, the MAC patch interprint zone 330 contains patches for two different colors. The MAC patch interprint zone is followed by another customer image 340. Purge patch 700 is laid out in unused portion of the customer image within image frame 340. It is understood that FIG. 3 is just one example of the many different types of layouts that can be utilized.

Example of purge patches that could be used in the commercially available IGEN3® printing press manufactured by Xerox Corporation. Considering images widths 12" and less developed on the imaging surface of the photoreceptor belt. The 10 pitch mode image panel is approx. 228 mm×364 mm. If one leaves a 3 mm space between the customer image and the patch area to account for registration tolerance, etc, and a 3 mm on the LE and TE of the patch, this leaves a patch size of approximately 56 mm×222 mm. This equates to an area coverage of ~16% for writing the purge while run patches. This would allow ~4% per color; with a patch size of approximately 14 mm wide by 222 mm long). This is close to the area coverage (including MAC Patch) at which low area coverage problem is mitigated. The patch size can be scale by the print controller in the process direction for the other pitch modes. For instance in 5 pitch mode the patch size would automatically scale to 14 mm wide by 496 mm long.

Figure 4:
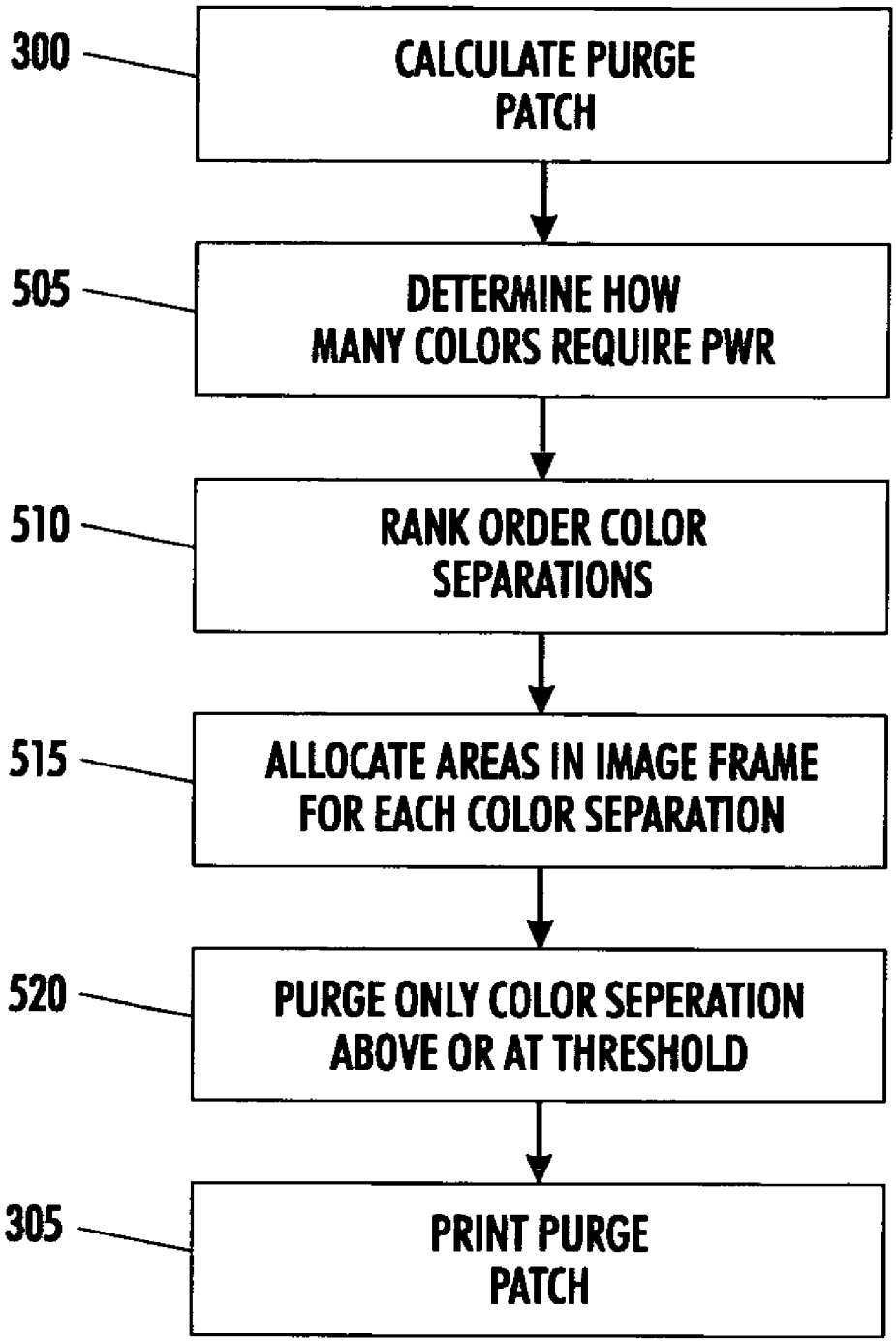

Now focusing on FIG. 4 illustrating the Purge While Run Processes for Improved Toner Usage and Productivity of the present disclosure, purge while run (PWR)) creates patches in the unused area of the customer image panel increasing the material throughput in the system as shown in FIG. 4, the step 300 includes determining how many colors require PWR this is accomplished by examining which color separations are above or at a predefined threshold level associated with each color separation (step 505) which is preferably less than the ATP threshold level. Next at step 510 the color separations are rank ordered based preferably on toner age, but may also be rank ordered by the amount of DMA needed to be purged or other factors. Next, an area for the purge patch is defined on an unused portion of an imaging frame and within the purge patch a plurality of purge patch regions defined therein. The purge patch regions can have a predefined size or can be varied in size or area. Next, one or more color separations are allocated to one or more purge patch regions based on the rank ordering results in step 510. In one embodiment, for example, patch regions 1-3 are equal to each other in area, but each individually approximately twice the area of patch region 4.

Examples of allocation are described below. For reference refer back to purge patch 700 and region 1-4 shown in FIG. 2:

If one color separation needs to PWR then the larger regions 1 and 2 are assigned to be printed with that one color separation.

If two color separations need to PWR then the larger regions 1 and 2 are assigned to be printed with the higher ranked color separation while the lower rank color separation is assigned to regions 3 and 4, which together are smaller than the sum of the areas of regions 1 and 2.

If three color separations need to PWR then the larger regions 1 and 2 are assigned to be printed with the highest ranked color separation while the second ranked color separation is assigned the smaller region 3. The lower ranked color separation is assigned the smallest region 4.

If four color separations need to PWR then each region is assigned a single color separation. Black is assigned to region 4 as it has the highest DMA. In the printer's Black Only Mode (BOM) black is assigned to at least one region.

An additional mode of scheduling PWR patches may be specified as follows. In this mode the maximum number of colors assigned to the PWR patches at any one time is limited to 3, termed a "limit 3" algorithm. In this algorithm if four color separations need to PWR then the larger regions 1 and 2 are assigned to be printed with the highest ranked color separation while the second ranked color separation is assigned the smaller region 3. The third ranked color separation is assigned the smallest region 4. The fourth ranked color separation is unassigned a region, but is assigned a region when future rank reordering advances it to one of the top 3 ranking positions. Applicants have found that when all four colors require a PWR patch the time to ATP auto toner purge can be greatly extended by NOT purging toner from the lowest ranked color separation but rather by limiting the PWR patch printing to the 3 highest ranking cases. This improves the print efficiency (duty cycle) which will ultimately improve PR life.

Alternatively, an analogous "limit 2" PWR algorithm may also be specified and is similarly useful for delaying the time between ATP instances and improving print productivity. In this algorithm the top ranked color separation is assigned in patch regions 1 and 2 and the second ranked color separation is assigned to patch regions 3 and 4. When 3rd or 4th color requires PWR it is not assigned a PWR patch until future rank reordering advances it to one of the top 2 rankings.

Figure 5:
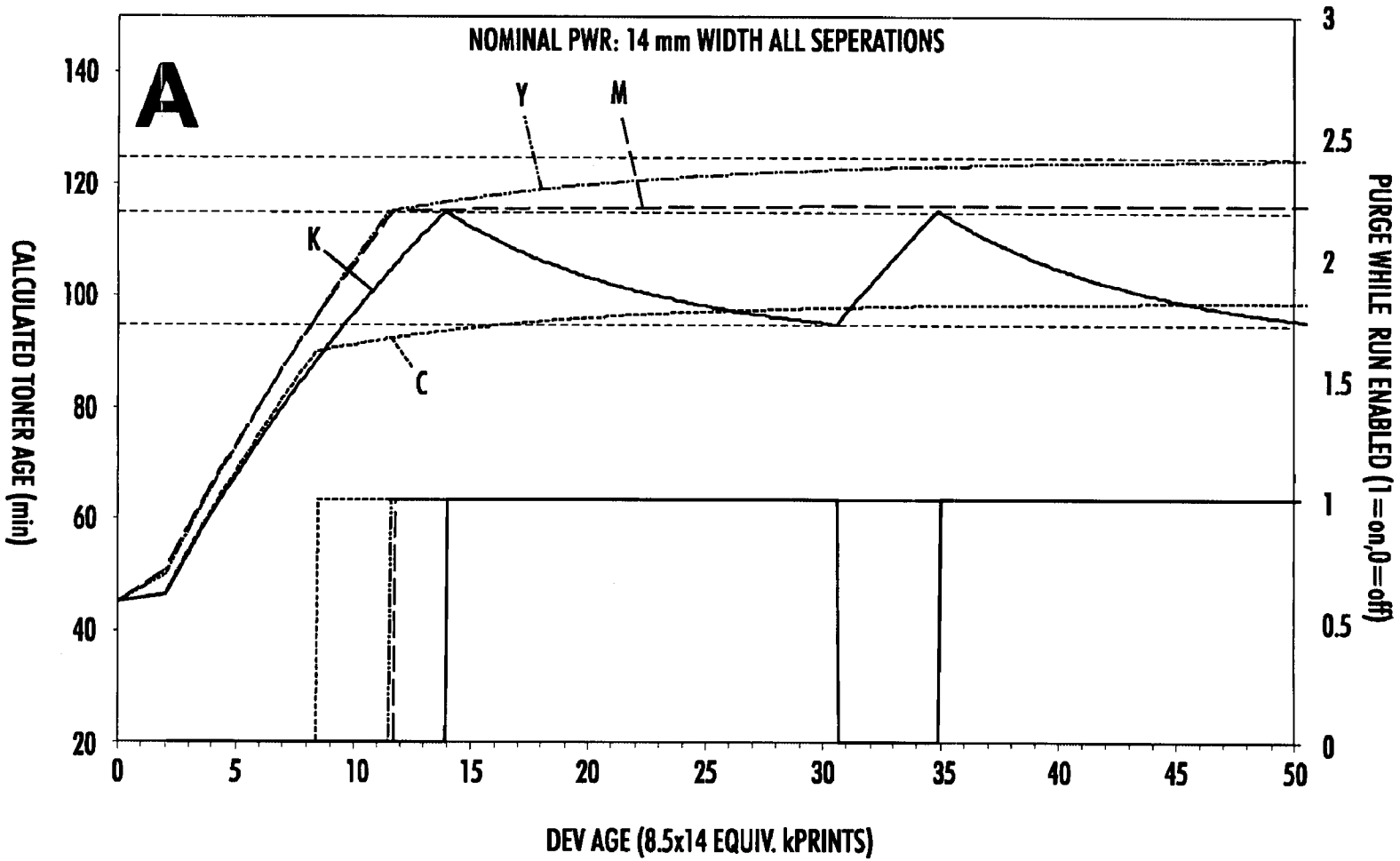
Figure 6:
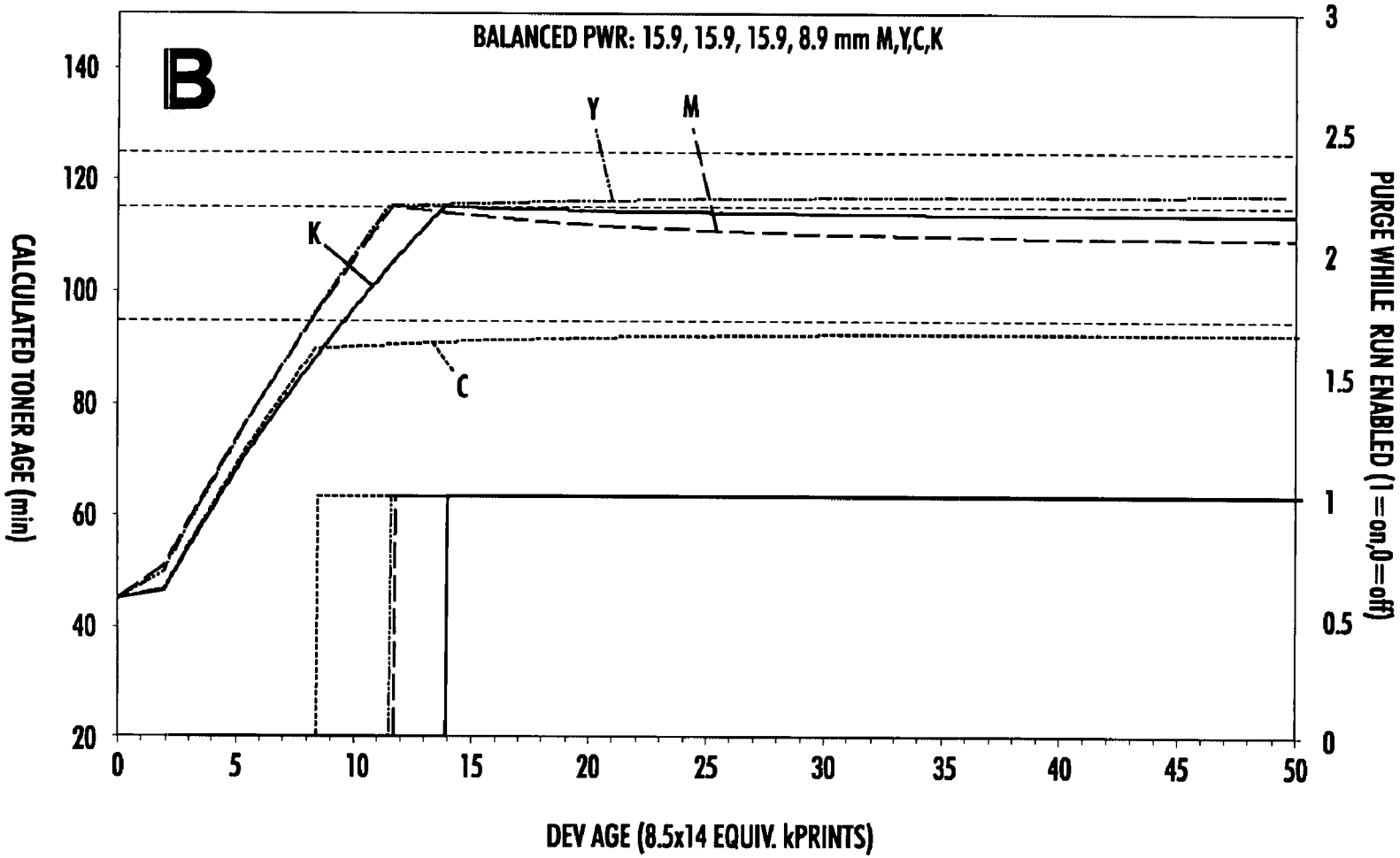

Applicants have performed modeling of the PWR process of the present disclosure. FIG. 5 shows a toner age profile vs. developer age for a document containing 2% MYCK with the current 14 mm wide PWR patches. The figure shows that black toner age cycles between enable and disable set points indicating that more than enough PWR toner is being laid down to prevent ATP. On the other hand, cyan and yellow toner ages rise to just below the ATP threshold indicating a lack of functional balance between the color and black PWR patches. Toner age modeling was done to functionally balance the four PWR patch separations such that black gets less PWR toner mass and each of the color separations gets a little more. This results in a patch width of 15.9 mm for M/Y/C and 8.9 mm for black. The resulting modeled TA profiles after balancing are shown in FIG. 6. Note that the MYCK toner ages cycle between the enable and disable set points at about the same frequency indicating a balanced usage of PWR toner. Another advantage of PWR patch balancing is that the maximum steady state toner age is lower in the balanced scenario. Analysis of ATP frequency running the balanced and unbalanced scenarios shows that the nominal PWR process eliminates ATP for image area coverage as low as 2%. With the balanced PWR stripes, ATP is eliminated when the image area coverage is as low as 1.5%.

While the above process balances the toner usage among the separations, it is not necessary to use a fixed width PWR patch for each separation. Applicants also propose to use a variable width PWR patches whose widths are calculated during run time based on the average image area coverages of the document(s) as they are printing. The PWR width would be based on (1) the number of separations requiring PWR, (2) the SADMA of each separations, and (3) the average area coverage of those separations with a lower area coverage running a proportionately higher PWR area (width).

To eliminate ATP altogether requires increasing the area (width) of the PWR patch. This can be done by allocating the space of 2 PWR patches when not all separations require a PWR patch. This is not considered a large limitation since few customers actually print low area coverage in all 4 separations. Two double wide or "smart PWR patches" are possible because the color and black PWR patches are of different sizes. Toner age modeling of all the possibilities of the double wide patches for all four separations were done to determine whether enough PWR toner is printed to eliminate ATP even when the image area coverage for any 2 separations is 0%. Key modeling variables included the PWR duty cycle, the PWR enable/disable set points relative to the ATP threshold and the paper width. The PWR duty cycle is the determined from the number of belt cycles that PWR patches are printed to the number of belt cycles that it is not printed, i.e. patch cleaning cycles. The modeling results in FIG. 7 assumed that the PWR enable threshold is 10 toner age units below the ATP threshold and the PWR disable threshold is 20 toner age units below the PWR enable threshold. For 12"-12.69" paper widths the PWR patch widths are proportionately scaled down in width to accommodate the reduced area available to the patches. The modeling results are shown in the table in FIG. 7 as a function of paper width and PWR duty cycle. In general conditions exist for which the smart PWR patches are projected to eliminate ATP even at 0% image area coverage so long as not all 4 separations require PWR. In general lower PWR duty cycles are preferred to minimize stress to the cleaner. The stress case of 12"-12.69" paper and the nominal 71% duty cycle allows ATP to be eliminated almost to 0% area coverage (<0.5% image area coverage).

Figure 8:
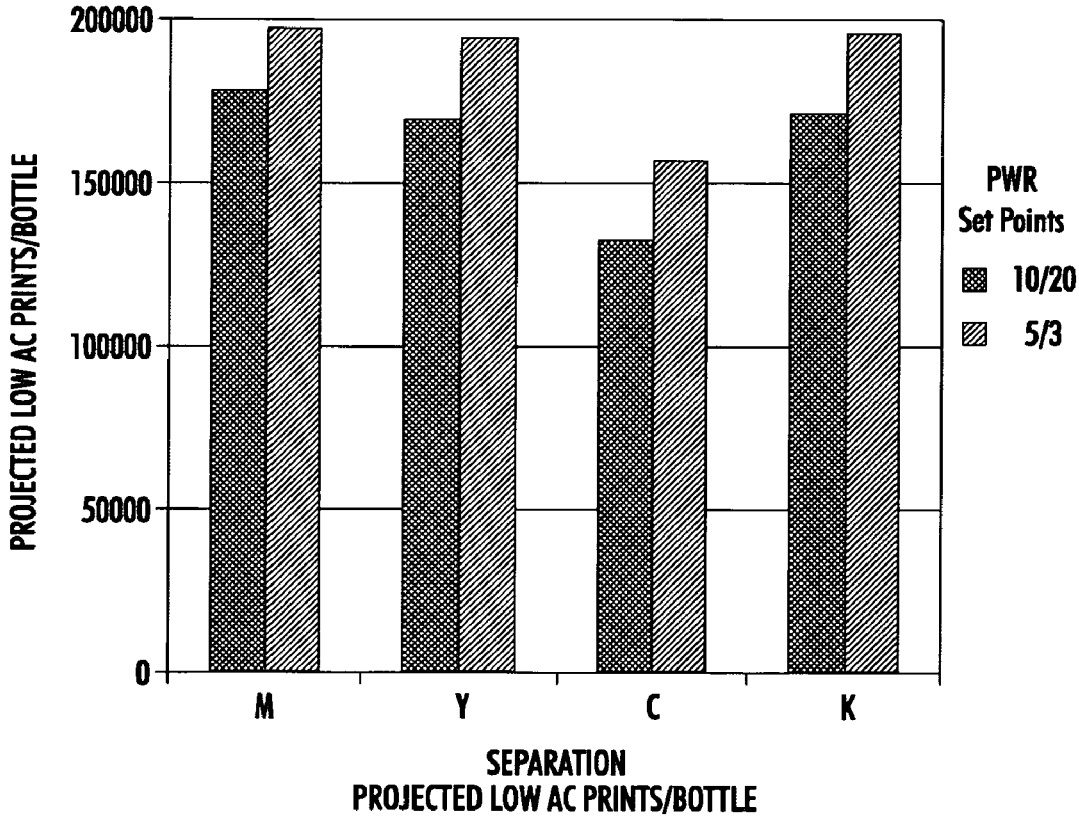
Figure 9:
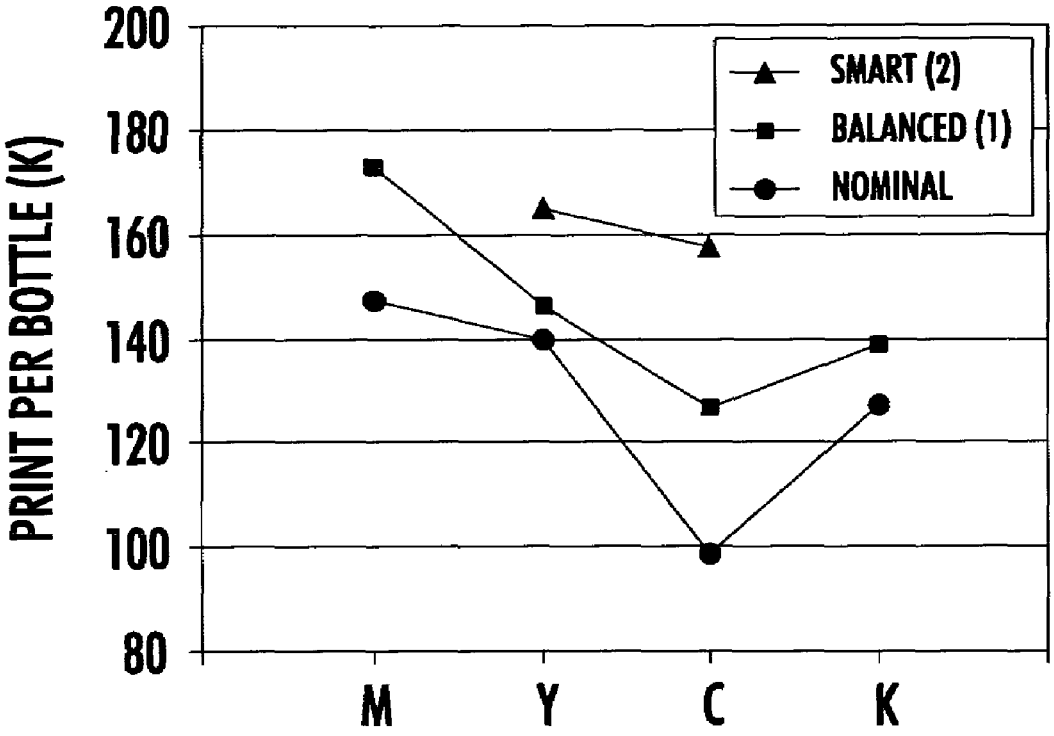

Increasing the latitude of the smart PWR process and improving the toner usage (prints per bottle) can be done by adjusting the PWR enable and disable setpoints. We have modeled toner usage as a function of PWR set points and paper size (given a 71% duty cycle) and have concluded that reducing both the PWR enable and disable offsets from the ATP threshold is very effective. Typically a 10-20% increase in toner usage is projected when switching from enable and disable offsets of 10 and 20 toner age units (as defined above; abbreviated 10/20) to 5/3. The projections are shown in the FIG. 8. The figure shows the projected prints per replenisher bottle for each separation at smart PWR enable/disable set points of 10/20 and 5/3 given a 71% PWR duty cycle and 11" wide paper. An increase of 10-20% depending on separation is realizable. FIG. 9 shows the prints/bottle results from machine testing. Toner usage results for the baseline (nominal) PWR process, balanced PWR (single patch) and smart PWR are given by the circle, square and triangle data points in FIG. 9. Relative to the baseline PWR, the balanced and smart PWR show increases for yellow and cyan of 14% and 25% respectively. Thus the combination of process improvements described above lead to eliminating ATP and significant increases in prints/bottle. This will result in improved productivity (up time) and increased customer satisfaction.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed is:

1. An electrostatic printing machine having a plurality of color stations having a method for maintaining a preset toner age in each of said plurality of color stations, comprising:

determining a toner age for each of said plurality of color stations;

determining if purge while run (PWR) is required based on said toner age for each of said plurality of color stations;

defining an area on an unused portion of an imaging frame for a purge patch, said defining includes sizing a plurality of purge patch regions wherein each of said purge patch regions may have a different size;

allocating each of said plurality of purge patch regions to at least one color plane from a group of color separations.

2. The method of claim 1, wherein said determining if purge while run is required step includes reviewing a print job comprising job images;

performing a pixel count for each color plane on a sheet level of the print job;

converting the pixel count to an estimated developed toner mass per color plane; and updating the toner age per color plane;

activating or inactivating a color station depending on the comparison of the toner age per color plane to purge while run enable and disable reference values; and Purge while run with said color station if the updated toner age per color plane is substantially greater than a toner age reference value corresponding to a purge while run enable set point.

3. The method of claim 1, wherein said allocating step includes rank ordering each color separation from said group of color separations based on toner age.

4. The method of claim 1, wherein said allocating step includes rank ordering each color separation from said group of color separations based on the amount of toner needed to be purged.

5. The method of claim 1, wherein said allocating step includes assigning at least two of said plurality of purge patch regions if one color separation from said group of color separations requires purge while run.

6. The method of claim 1, wherein said allocating step includes assigning at said least two of said plurality of purge patch regions if two color separations from said group of color separations requires purge while run and assigning one color separation the larger sized purge patch region of said least two of said plurality of purge patch regions based on toner age.

7. The method of claim 1, wherein said allocating step includes assigning at least four of said plurality of purge patch regions if two color separations from said group of color separations require purge while run and assigning two large purge patch regions to the color separation with the highest rank ordering and one large and one small purge patch region to the color separation with the second highest rank ordering.

8. The method of claim 1, wherein said allocating step includes assigning at said least three of said plurality of purge patch regions if three color separations from said group of color separations that requires purge while run and assigning one color separation the larger sized purge patch region of said least three of said plurality of purge patch regions based on toner age.

9. The method of claim 1, wherein said allocating step includes assigning at least four of said plurality of purge patch regions if three color separations from said group of color separations require purge while run and assigning two large purge patch regions to the color separation with the highest rank ordering, one large purge patch region to the color separation with the second highest rank ordering, and a small purge patch region to the color separation with the lowest rank ordering of said three color separations.

10. The method of claim 1, wherein said allocating step includes assigning each purge patch region one color separation when 4 colors require purge while run, in the full color printing mode the colors are assigned the larger purge patches and black is assigned the smaller purge patch.

11. The method of claim 1, wherein said allocating step includes assigning at least 2 purge patch regions to black when the printer is in a black only printing mode.

12. The method of claim 1, wherein said allocating step includes assigning at least four of said plurality of purge patch regions if four color separations from said group of color separations require purge while run and assigning two large purge patch regions to the color separation with the highest rank ordering, one large purge patch region to the color separation with the second highest rank ordering, one small purge patch region to the color separation with the third highest rank ordering, and assigning no purge patch regions to the color separation with the lowest rank ordering.

13. The method of claim 1, wherein said allocating step includes assigning at least four of said plurality of purge patch regions if three or four color separations from said group of color separations require purge while run and assigning two large purge patch regions to the color separation with the highest rank ordering, one large and one small purge patch region to the color separation with the second highest rank ordering, and assigning no purge patch regions to the color separations with the lowest two rank orderings.

14. The method of claim 13, wherein said group of color separations includes yellow, magenta, cyan and black.

15. The method of claim 1, wherein said defining step includes varying the size of at least one of said plurality of purge patch regions.

16. The method of claim 15, wherein varying the size includes varying the width of said at least one of said plurality of purge patch regions.

* * * * *